US007591441B1

(12) United States Patent
Rossman

(10) Patent No.: US 7,591,441 B1
(45) Date of Patent: Sep. 22, 2009

(54) ADJUSTABLE GUTTER HANGER APPARATUS

(76) Inventor: Larry Rossman, 591 Catskill Ct., Grand Junction, CO (US) 81503

( * ) Notice: Subject to any disclaimer, the term of this patent is extended or adjusted under 35 U.S.C. 154(b) by 441 days.

(21) Appl. No.: 11/625,306

(22) Filed: Jan. 20, 2007

(51) Int. Cl.
*E04D 13/072* (2006.01)

(52) U.S. Cl. ..... 248/48.2; 248/300; 52/11

(58) Field of Classification Search ..... 248/48.1, 248/48.2, 300; 52/11, 12, 749.12, DIG. 11
See application file for complete search history.

(56) References Cited

U.S. PATENT DOCUMENTS

| | | | | |
|---|---|---|---|---|
| 488,075 | A * | 12/1892 | Kelso | 248/48.1 |
| 514,758 | A | 2/1894 | Lewis | |
| 985,860 | A * | 3/1911 | Timm | 248/48.1 |
| 1,572,745 | A * | 2/1926 | Meunier | 248/48.1 |
| 1,992,758 | A * | 2/1935 | Meunier | 248/48.1 |
| 2,550,780 | A * | 5/1951 | Cohn | 248/48.1 |
| 3,895,769 | A * | 7/1975 | Hagaman | 248/48.2 |
| 4,432,518 | A | 2/1984 | Navarre | |
| 4,813,190 | A | 3/1989 | Wittig | |
| 5,067,675 | A | 11/1991 | Brant | |
| 6,651,937 | B1 * | 11/2003 | Wilson | 248/48.1 |
| 6,951,323 | B1 | 10/2005 | McNichol | |
| 7,418,801 | B2 * | 9/2008 | Loveless | 52/11 |

* cited by examiner

*Primary Examiner*—Korie H. Chan
(74) *Attorney, Agent, or Firm*—Crossley Patent Law; Mark Crossley

(57) ABSTRACT

An adjustable gutter hanger apparatus for hanging gutters on a structure, the apparatus having a bendable bracket/strap for fastening to a fascia, rafter, roof, or other surface of the structure is disclosed. The stirrup, which supports a plurality of gutter shapes, is affixed to the bracket/strap, adjustably. The strap of the bracket/strap passes over and captures the gutter. The strap is then adjustably fastened to the opposite side of the gutter, thereby fully entrapping the gutter. Spaced apart orifices in the strap and selectable slots in the stirrup enable the gutter to be selectively hung at the proper angle to a roof.

16 Claims, 6 Drawing Sheets

ADJUSTABLE GUTTER HANGER APPARATUS

BACKGROUND OF THE INVENTION

Rain gutters are installed on many types of buildings. Various hangers are manufactured and used for this purpose. Two significant aspects of gutter hangers are aesthetics and function. Function dictates that gutter hangers typically be attached to rafters, fascia or to a roof. Fascia attachment is the prevalent form of gutter attachment. Fascias are either perpendicular to the ground or are disposed at a 90-degree angle to the pitch of the roof of the building. Fascia which is fitted at a 90-degree angle to the roof is termed angled fascia. Angled fascia is commonly used on roofs of custom-built homes. While such homes may or may not originally be fitted with gutters, fitting either initially or at a later date requires specific gutter hangers, as the gutter must be affixed approximately horizontal to the ground. Gutter hanging is further complicated with the fact that custom homes typically have several different roof pitches, requiring that the gutters be capable of mounting at various angles.

Some gutter hanging devices have addressed the need for varying angle gutter attachments with wedges of wood or metal, which are awkward. Such wedges also do not afford all of the angles needed for proper gutter attachment angles. Other hangers employ special bending tools for bending various attachment hardware, an undesirable approach to the problem, even if only labor time is considered. A superior means of gutter attachment provides a mechanically adjustable hanger for angle adjustment. Ease of installation and appearance therein become significant factors. What is needed is a gutter hanger apparatus which affords angular attachment, with ease of installation and an aesthetically appealing appearance, coupled with the ability to conform to a variety of angles. The present adjustable gutter hanger apparatus addresses the above-discussed needs, while also providing for gutter attachment to fascia, roof, or rafters.

FIELD OF THE INVENTION

The gutter hanger apparatus relates to rain gutter attachment devices and more especially to an adjustable gutter attachment apparatus which affords an aesthetically appealing apparatus with basic mechanical angular adjustment, while remaining cost efficient.

DESCRIPTION OF THE PRIOR ART

Prior related art U.S. Pat. No. 4,432,518 issued to Navarre on Feb. 21, 1984 teaches a dually adjustable eaves trough bracket for installation of eaves trough at varying angles to roof rafter and eaves board structure. The bracket includes a securing plate adapted for vertical orientation to the roof eave structure and includes a plurality of braces slots, and further includes a trough support member for interlocking connection to the upper end of the securing plate. The multiple part assembly provides angular adjustment with brace slots. The assembly does not provide for installing gutters to a plurality of fixtures, as does the present apparatus. The assembly is not used to install gutters to rafters. The assembly is not used to install gutters to a roof. Machine screws with nuts are required to fasten the assembly together, which is more awkward, time consuming, and less visually appealing than the present apparatus. Further, the assembly requires the use of a spring clip of separate manufacture to secure the gutter to the assembly.

Other gutter hangers in prior art are provided in a variety of shapes which typically are mounted to a roof, which is not desirable in many cases. Further, many gutter hangers provided do not provide a means for capturing a gutter. Winds and debris are, therefore, free to dislodge the gutter from the hanger. Still other hangers provide for capturing a gutter, but do so only via gutter invasion, such as with screw holes. Gutter invasion is undesirable due to labor, appearance, leaking, electrolysis, and staining and rusting of metals.

While the above-described devices fulfill their respective and particular objects and requirements, they do not describe an adjustable gutter hanger apparatus that provides for the advantages of the present adjustable gutter hanger apparatus. In this respect, the present adjustable gutter hanger apparatus substantially departs from the conventional concepts and designs of the prior art. Therefore, a need exists for an improved adjustable gutter hanger apparatus.

SUMMARY OF THE INVENTION

The general purpose of the adjustable gutter hanger apparatus, described subsequently in greater detail, is to provide an adjustable gutter hanger apparatus which has many novel features that result in an improved adjustable gutter hanger apparatus which is not anticipated, rendered obvious, suggested, or even implied by prior art, either alone or in combination thereof.

To attain this, the adjustable gutter hanger apparatus provides for installing gutters to fascia, to roofs, or to rafters, as well as other surfaces which may be proximal to a roof edge. The apparatus requires only typical screws and fasteners, without the need for machine screws, nuts, or bolts, or specialized tools. The apparatus provides for a multiplicity of angular gutter attachments to any of the above fixtures. The apparatus does not require any other extraneous components or additions to the apparatus, save the gutters themselves.

The apparatus is comprised of either two or three major components, depending upon the embodiment, and typically used fasteners, such as wood screws and self-tapping metal screws. The major components are the bracket, the gutter stirrup, and the strap, in the first embodiment. In the second embodiment, only two components serve to hang the gutters correctly, as the bracket and adjustment strap are combined.

The first embodiment of the apparatus includes a separate bracket which has an extension off of the top of the bracket body. An additional embodiment of the bracket incorporates a stepped extension. The stepped extension protrudes forwardly from the top of the bracket body, at a 90-degree bend from the body, then upwardly off of the protrusion, at 90 degrees to the protrusion. An extension orifice is disposed proximal to the upper end of the extension.

The second embodiment of the apparatus provides a bracket combined with the strap. The combined bracket/strap also comprises a plurality of spaced apart extension orifices, proximal. Both bracket embodiments provide a hinge for swivel connection of the first end of the strap. Both bracket embodiments provide score lines for bending as needed for attachment to fixtures in gutter hanging. Both bracket embodiments provide an orifice at the top of the hinge and a matching orifice in the bracket body, such that the stirrup can be better anchored to the bracket.

The gutter stirrup is generally u-shaped. The stirrup can be manufactured to fit a plurality of gutter profiles to surround the bottom and opposing sides of the gutter. The curl of the stirrup is capable of at least partially surrounding the outside lip of the gutter. Gutter profiles supported by the stirrup include, but are not limited to, half round with inside curl, half round with outside curl, K style, quarter round, box shape, and fascia gutter shaped. Stirrups are also provided with indents in an approximate center of the cross section of the stirrup. Indents are provided in a plurality of shapes, which include but are not limited to beaded, pointed, and square. Indents provide aesthetic appeal as well as stirrup strengthening.

The apparatus provides the most basic means of gutter attachment. The apparatus captures the gutter as well. Additionally, no gutter invasion is required. No specialized tools are required to install the hangers and thence the gutters. Typically, a screwdriver is the only tool needed. Pliers are used in bending any component which requires such, with score lines provided to ease bending.

A further significant advantage of the apparatus is that holding a gutter out from angled fascia, as needed, at a desired angle, is provided for without other hardware, screws, alterations, wedges, or gutter invasion. In many instances, for example, fascia is at a 90-degree angle to the roof, but not perpendicular to the ground. The apparatus comprises a swivel hinge at the bottom of both embodiments of the bracket. To exemplify, in the event of a fascia being angled inwardly in relation to the ground and/or structure, and not perpendicularly, the bendable hinge is bent outwardly to counteract the fascia-to-ground angle.

The stirrup is then positioned to support the gutter at a horizontal to the ground. The hinge is of a length to allow for significant angle correction in any application. Holes in the strap are situated at equidistant intervals for adjustment to odd or even roof pitches, odd pitches such as 1/12, 3/12, 5/12, and the like. Even roof pitches are exemplified by those such as 2/12, 4/12, 6/12, and the like. Two slots on the outer end of the stirrup determine odd or even pitch use, respectively, through which the strap bends. The combined use of specific holes in the strap and slots in the stirrup enable the gutter to be hung at a horizontal plane to the ground. Further, should an installer wish to install the strap to the roof, and not the bracket, a score line is provided on the strap so that it can easily be bent or snipped off of the fascia bracket, in the combined bracket/strap, for roof attachment.

Thus has been broadly outlined the more important features of the improved adjustable gutter hanger apparatus so that the detailed description thereof that follows may be better understood and in order that the present contribution to the art may be better appreciated.

An object of the adjustable gutter hanger apparatus is to provide for gutter hanging at proper gutter to ground angle.

Another object of the adjustable gutter hanger apparatus is to provide for stirrups manufactured to fit the shape for virtually any gutter.

A further object of the adjustable gutter hanger apparatus is to provide for hanger attachment to a roof.

An added object of the adjustable gutter hanger apparatus is to provide for hanger attachment to fascia.

And, an object of the adjustable gutter hanger apparatus is to provide for hanger attachment to a rafter.

Still another object of the adjustable gutter hanger apparatus is to provide for hanger attachment to other objects associated with roofs.

Additionally, an object of the adjustable gutter hanger apparatus is to provide for hanging a gutter with only two or three pieces of apparatus, and fasteners.

Yet another object of the adjustable gutter hanger apparatus is to provide for hanging the apparatus and gutters with commonly used fasteners, such as wood screws.

And, too, an object of the adjustable gutter hanger apparatus is to hang gutters properly without utilizing specialized tools.

These together with additional objects, features and advantages of the improved adjustable gutter hanger apparatus will be readily apparent to those of ordinary skill in the art upon reading the following detailed description of presently preferred, but nonetheless illustrative, embodiments of the improved adjustable gutter hanger apparatus when taken in conjunction with the accompanying drawings.

In this respect, before explaining the current embodiments of the improved adjustable gutter hanger apparatus in detail, it is to be understood that the adjustable gutter hanger apparatus is not limited in its application to the details of construction and arrangements of the components set forth in the following description or illustration.

Those skilled in the art will appreciate that the concept of this disclosure may be readily utilized as a basis for the design of other structures, methods, and systems for carrying out the several purposes of the improved adjustable gutter hanger apparatus. It is therefore important that the claims be regarded as including such equivalent constructions insofar as they do not depart from the spirit and scope of the adjustable gutter hanger apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 10 thereof, the principles and concepts of the adjustable gutter hanger apparatus generally designated by the reference number 10 will be described.

Figure 1:
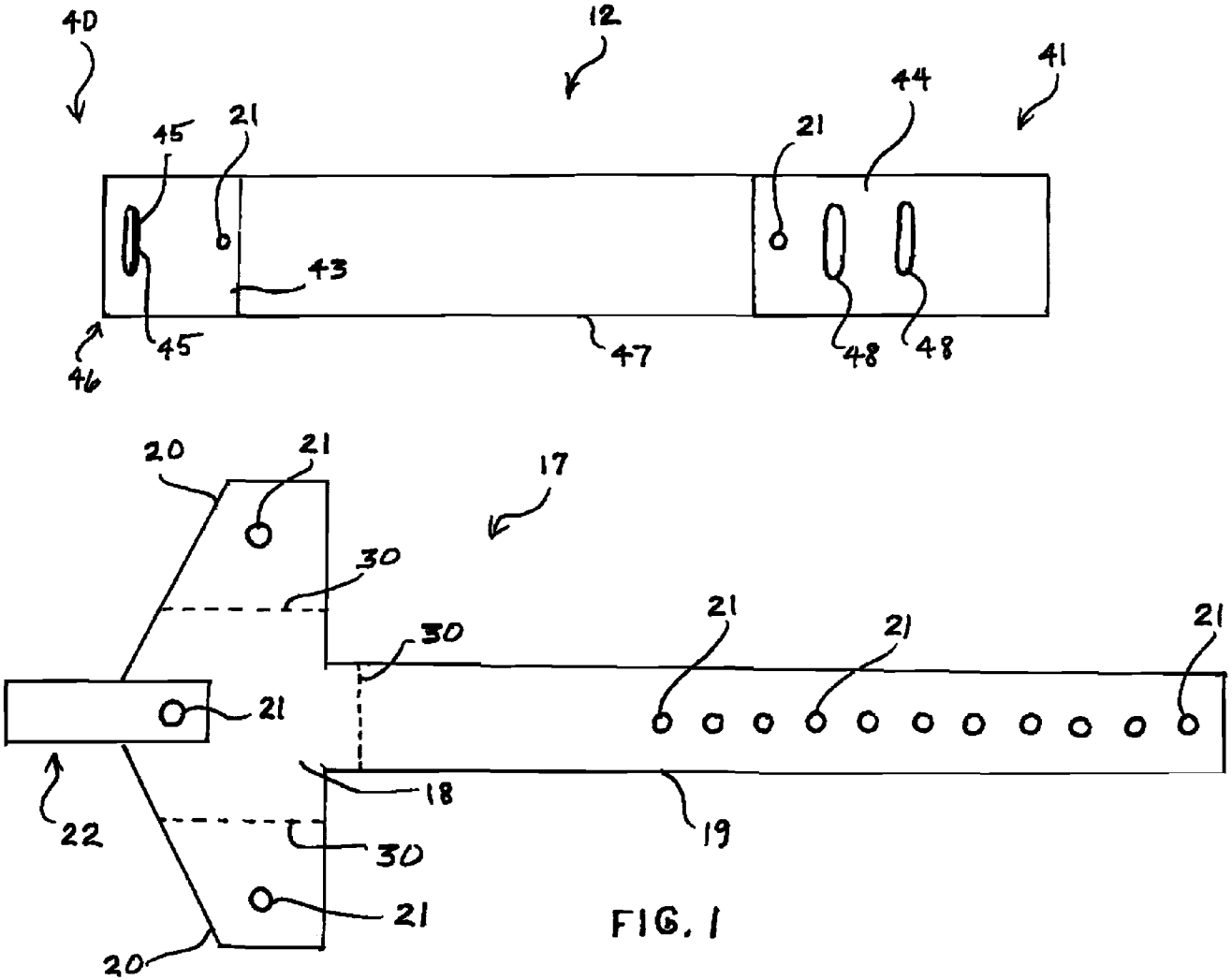
FIG. 1 is a top plan view of the stirrup and combined bracket/strap of a preferred embodiment of the apparatus.

Referring to FIG. 1, the adjustable gutter hanger apparatus 10 for hanging gutters 60 on a structure comprises a combined bracket/strap 17 for fastening to the structure. The bracket/strap 17 comprises a bracket body 18 having a top, a bottom, and two spaced apart sides. An ear 20 is disposed on each of the body 18. At least one orifice 21 is disposed in each ear 20. The 180 degree looped hinge 22 is extended from the bottom of the body 18. The hinge 22 progresses downwardly from the body 18, forms a 180-degree bend, then rises vertically to mirror the original side of the hinge 22. An orifice 21 is disposed in the top of the vertical rise of the hinge 22. An orifice 21 is disposed in the body 18 to correspond to the hinge 22 orifice 21. The strap 14 is seamlessly extended from the top of the body 18. The strap 14 has a first end, a second end, and a length therebetween. The first end of the strap 14 extends from the body 18.

A plurality of spaced apart orifices 21 is disposed along a part of the length of the strap 14. The orifices 21 are proximal to the second end of the strap 14 and further progress along a part of the length toward the opposite strap 14 end. A score line 30 is disposed on the strap 14 proximal to the body 18. The score line 30 provides more than one function. The score line 30 enables easier bending of the strap 14, as needed when the strap 14 is bent over the gutter 60 to be affixed to the stirrup 12. The score line 30 also provides a guide for more easily cutting the strap 14 from the body 18. As example, it is sometimes desirable to remove the strap 14 from the body 18, and then affix the first end of the strap 14 to a structure roof, prior to affixing the second end of the strap 14, over a gutter and to the stirrup 12 tang 44.

Figure 2:
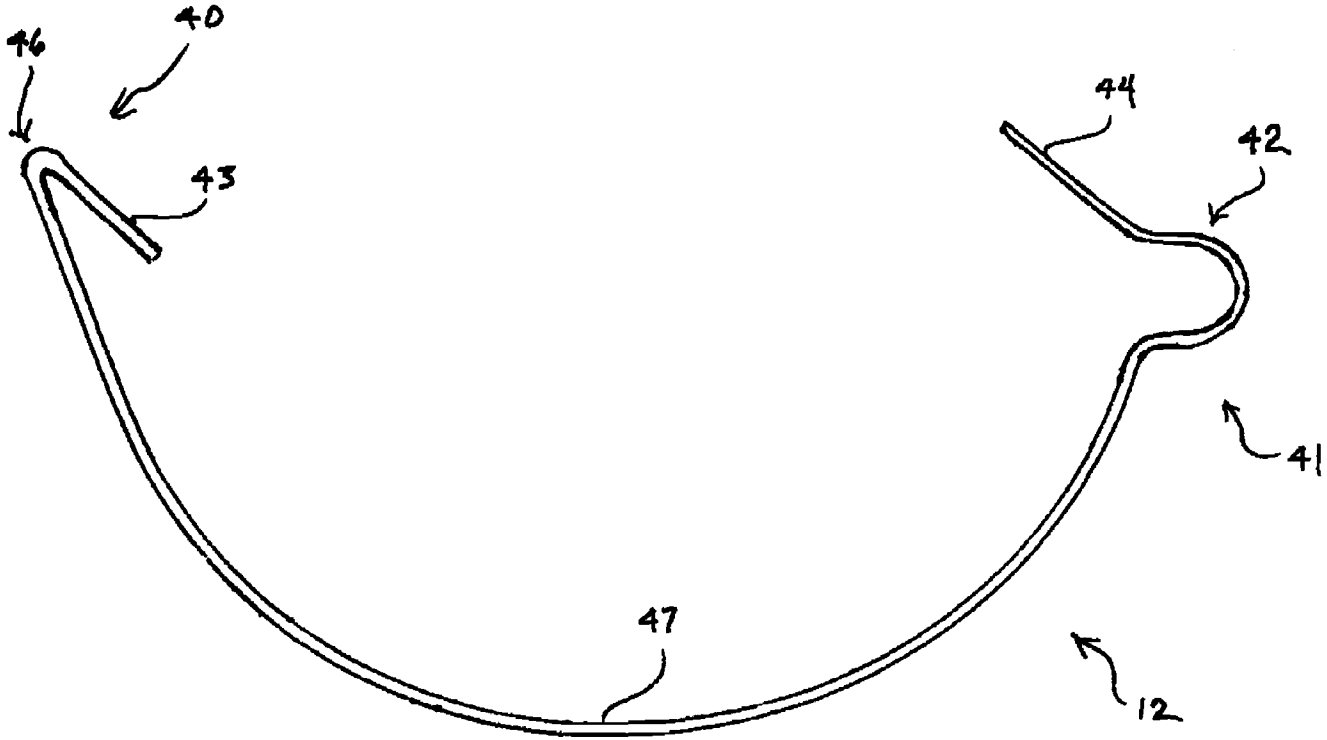
FIG. 2 is a side elevation view of the stirrup.

Referring to FIGS. 1 and 2, the 12 stirrup is manufactured to fit around an outside of and under a gutter 60. The stirrup 12 has a first end 40, a second end 41, and a loop 47 therebetween. The stirrup 12 further comprises a bend 46 at the first end 40. The bend 46 has an arc having a range of 20 degrees through 45 degrees. A hinge slot 45 is disposed in each side of the bend 46. The stirrup first end 40 terminates in the bend tab 43. The bend tab is provided with an orifice 21. After the stirrup first end 40 slots are onto the hinge 22, a fastener 90 selectively retains the assembly of the stirrup 12 and bracket/strap 17. The curl 42 is disposed on a second end 41 of the stirrup 12. The tang 44 is disposed on the end of the curl 42. At least two slots 48 are disposed in the tang 44. An orifice 21 is disposed in the tang 44. A fastener 90 selectively inserted into the orifice 21 retains the bend 46 slots 45 on the hinge 22.

Figure 3:
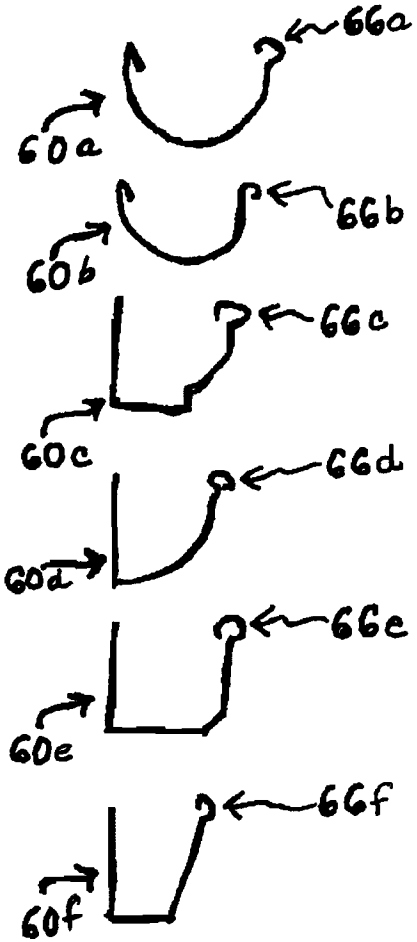
FIG. 3 is side cross sectional view of a plurality of gutter shapes which the stirrup supports.

With reference to FIG. 3, gutters 60 are provided in a plurality of shapes. The gutters 60 are not a part of the apparatus 10. Each gutter lip 66 is generally surrounded by the curl 42 of the stirrup 12. Each gutter 60 fits within the stirrup 12 in mounting to a structure. The strap 14 fits over the top of each gutter 60 and thereby traps a gutter 60 in mounting.

Figure 4:
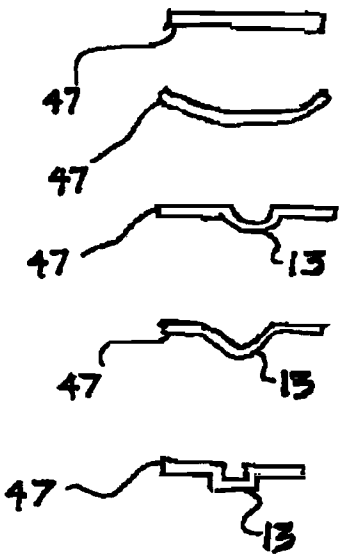
FIG. 4 is cross sectional view of the loops of a plurality of stirrups of the apparatus.

Referring to FIG. 4, the cross sectional views of the stirrup 12 loops 47 reveal the plurality of loop 47 shapes provided. A plurality of indent 13 shapes is further provided. The loop 12 indent 13 shapes illustrated are exemplary and do not define a limitation to loop 47 shapes and indents 13 provided.

Figure 5:
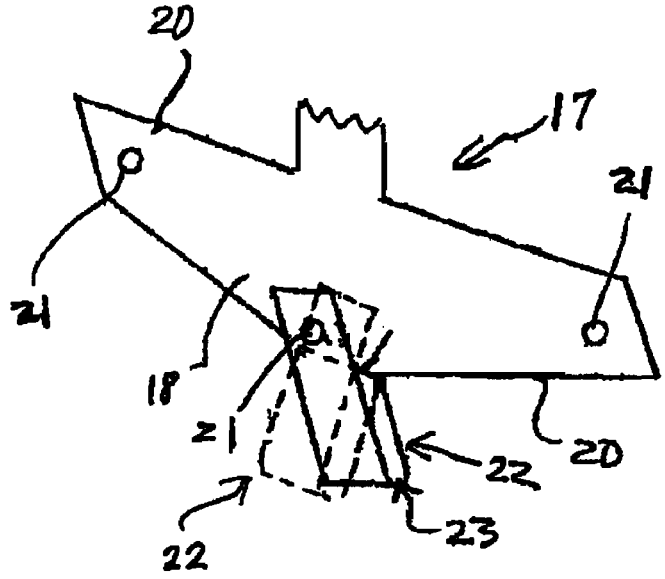
FIG. 5 is a perspective view of the combined bracket/strap, illustrating hinge bend capability.

Viewing FIG. 5, the hinge 22 is bendable. The same bendable hinge 22 is incorporated into both the bracket 16 and the combined bracket/strap 17. As the gutter 60 must be affixed at approximately a horizontal to the ground, the hinge 22 can be bent relative to the bracket body 18 to accomplish the desired gutter 60 angle. For example, with either the bracket 16 or the bracket/strap 17 affixed to the fascia of a structure and the fascia angled back at approximately 15 degrees from vertical, the hinge 22 is bent forwardly from the bracket body 18 to a position in which the hinge 22 is vertical relative to the ground. A gutter 60 is then capable of being hung at proper angle to the ground, as the outside of the gutter 60 can be elevated. The orifice 21 in the hinge 22 provides for trapping the bend 46 of the stirrup 12 in the hinge well 23, as a fastener 90 is inserted into the orifice 21.

Figure 6:
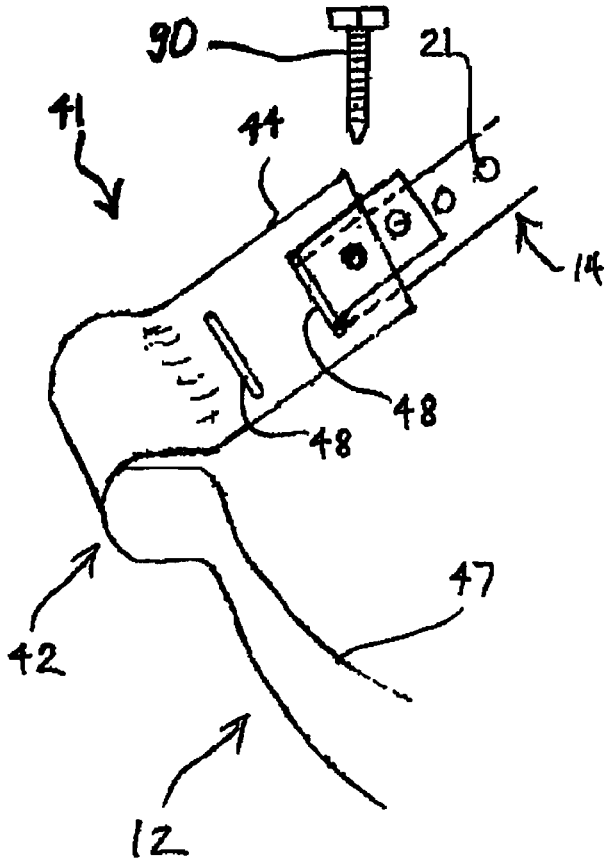
FIG. 6 is a perspective view of the stirrup second end with strap bend through one stirrup slot and fastener in preparation of securing the strap to the stirrup.

Referring to FIG. 6, the second end of the strap 14 is inserted through one of the slots 48 in the tang of the second end 41 of the stirrup 12. The strap 14 is bent back over the tang 44 to meet itself and for orifices 21 of the strap 14 to align in order to insert fastener 90 for securing the strap 14. The bend 46 slots 45 of the opposite end of the stirrup 12 are hung on hinge well 23 of the hinge 22 of the bracket 16 or of the bracket/strap 17. In order to hang the gutter 60 at the correct angle relative to the ground, the strap 14 is inserted into the chosen slot 48 of the tang 44. The strap 14 is pulled through the slot 48 as needed to bring the gutter to the desired angle. The strap 14 is then secured via the above-noted means. With the two slots 48 in the tang 44, and with the spacing of the orifices 21 in the strap 14, a plurality of roof pitches are addressed in hanging the gutter correctly. Orifices 21 in the strap 14 are situated at equidistant intervals for adjustment to odd or even roof pitches. Odd roof pitches are exemplified by those such as 1/12, 3/12, 5/12, and the like. Even roof pitches are exemplified by those such as 2/12, 4/12, 6/12, and the like. The two slots 48 on the tang 44 of the stirrup 12 accommodate odd or even pitch use, respectively. The stirrup 12 is therefore supportive under and substantially around any gutter 60. The strap 14 is affixed over the top of the gutter 60, thereby fully entrapping the gutter 60 without gutter 60 invasion, and without the need for any specialized tools or procedures or other parts, other than the fasteners 90.

Figure 7:
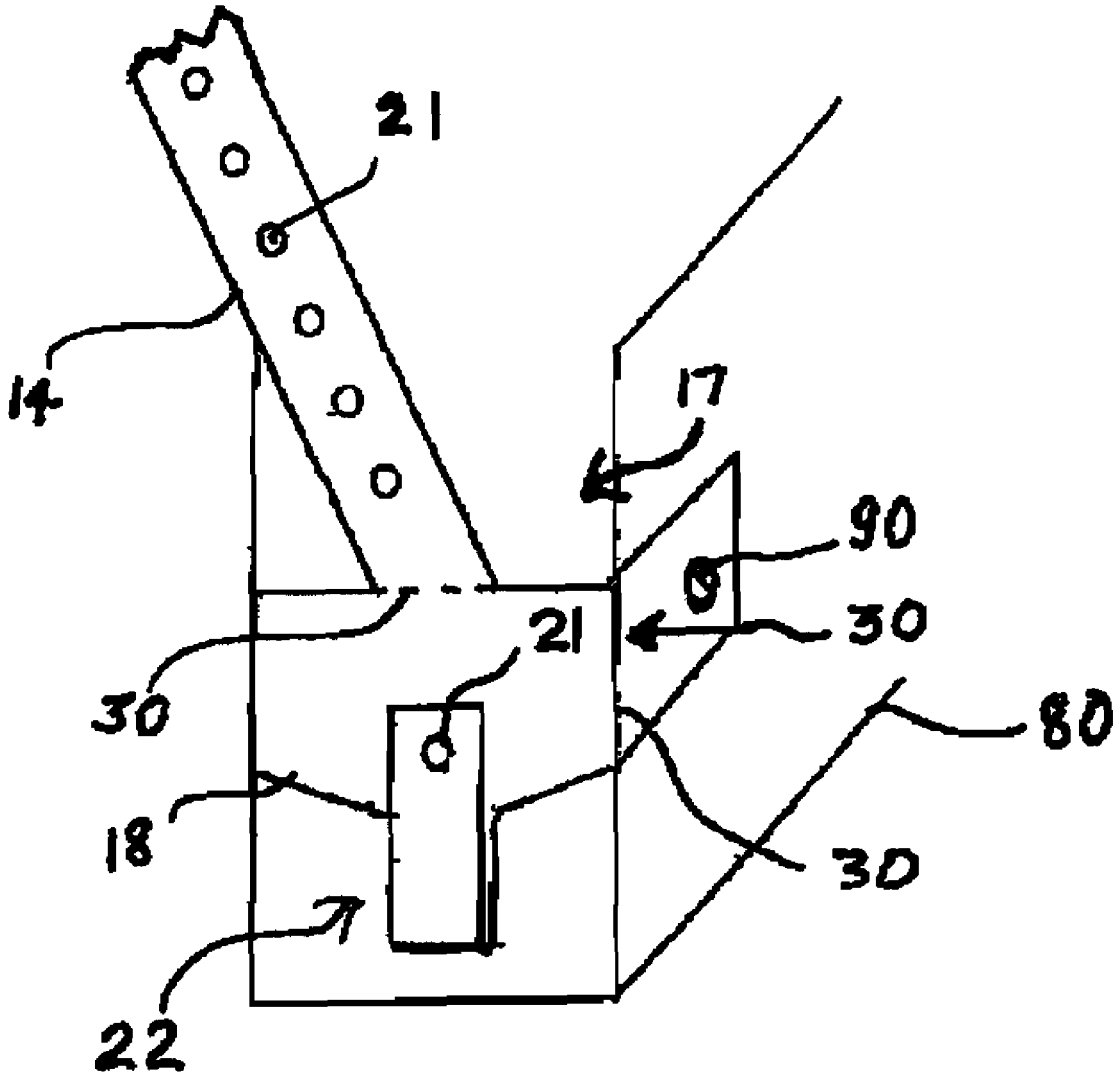
FIG. 7 is a perspective view of the bracket/strap affixed to a rafter.

With reference to FIG. 7, the bracket/strap 17 is bendable. Further, score lines 30 assist in potentially needed bends such as those required to affix the bracket 16 or the combined bracket/strap 17 to a rafter 80. And, the score line 30 is provided on the strap 14 proximal to the body 18 for either easier bends or for separating the strap 14 from the body 18.

Figure 8:
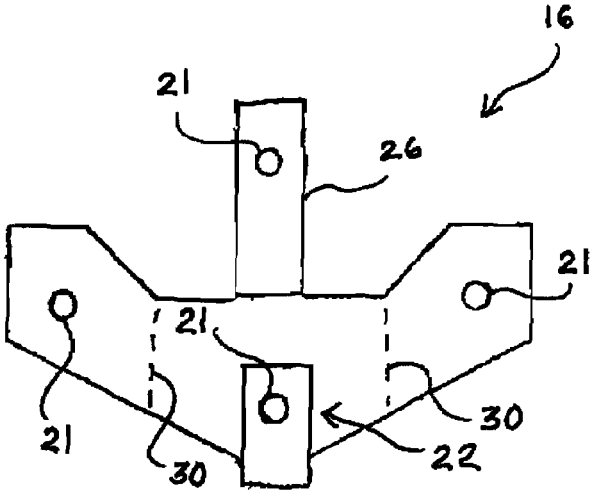
FIG. 8 is a front elevation view of the bracket.
Figure 9:
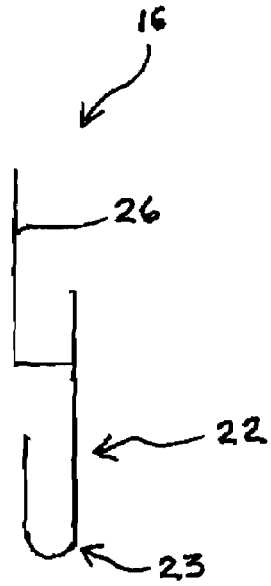
FIG. 9 is a side elevation view of the bracket of FIG. 8.
Figure 10:
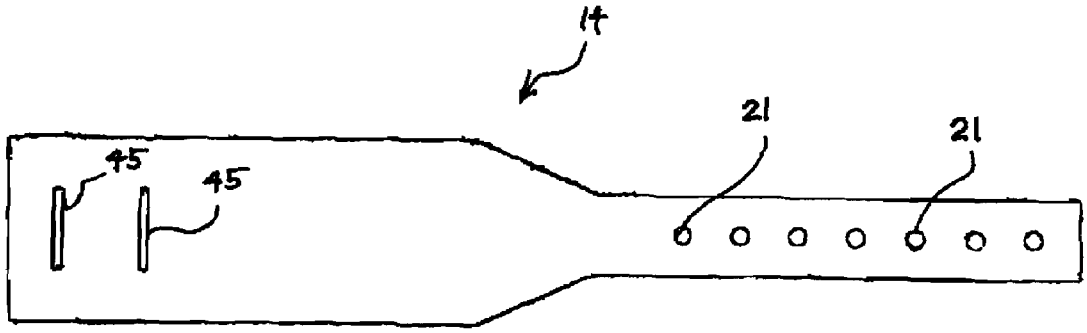
FIG. 10 is a top plan view of the strap.

Referring to FIGS. 8, 9, and 10 the alternate embodiment of the bracket 16 differs from the bracket/strap 17 in that the strap 14 is not a part of the bracket 16. The bracket 16 includes a stepped extension 26. The stepped extension 26 provides for insertion of the chosen slot 45 of the strap 14. After insertion of the chosen slot 45, the opposite end of the strap is looped through the chosen slot 48 of the stirrup 12, the strap passing over and retaining a gutter 60. The narrow strap 14 end is bent over and secured within the slot 45 via a fastener 90, thereby securing the gutter 90.

With respect to the above description then, it is to be realized that the optimum dimensional relationships for the parts of the adjustable gutter hanger apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the adjustable gutter hanger apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the adjustable gutter hanger apparatus may be used.

Therefore, the foregoing is considered as illustrative only of the principles of the adjustable gutter hanger apparatus. Further, since numerous modifications and changes will readily occur to those skilled in the art, it is not desired to limit the adjustable gutter hanger apparatus to the exact construction and operation shown and described, and accordingly, all suitable modifications and equivalents may be resorted to, falling within the scope of the adjustable gutter hanger apparatus.

What is claimed is:

1. A gutter hanger apparatus for hanging gutters on a structure, comprising, in combination:

a bendable bracket for fastening to the structure, the bracket comprising:

a bracket body having a top, a bottom, and two spaced apart sides;

an ear on each side of the body;
an orifice in each ear;
a hinge extended from the bottom;
an orifice in the hinge;
an orifice in the body corresponding to the hinge orifice;
an extension extended from the top;
at least one orifice proximal to a top of the extension;
a bendable strap, the strap having a first end, a second end, and a length therebetween, the strap further comprising:
two spaced apart slots in the first end of the strap;
a narrowing along a portion of the length through the second end of the strap;
a plurality of spaced apart orifices in the narrowing; and
a stirrup for fit around an outside of the gutter, the stirrup having a first end, a second end, and a loop therebetween, said stirrup further comprising:
a bend at the first end, the bend having an arc, wherein said arc is selected from the group consisting of 20 degrees through 45 degrees;
a hinge slot in an each side of the bend;
a curl on a second end of the stirrup;
a tang on an end of the curl;
at least two slots in the tang; and
an orifice in the tang.

2. The apparatus in claim 1 wherein the bracket extension is stepped.

3. The apparatus in claim 1 wherein a score line is provided in the bracket extension, the score line proximal to the bracket body.

4. The apparatus in claim 2 wherein a score line is provided in the bracket extension, the score line proximal to the bracket body.

5. The apparatus in claim 1 wherein the bracket is further comprised of a pair of score lines, each score line between the body and one of the ears.

6. The apparatus in claim 2 wherein the bracket is further comprised of a pair of score lines, each score line between the body and one of the ears.

7. The apparatus in claim 3 wherein the bracket is further comprised of a pair of score lines, each score line between the body and one of the ears.

8. The apparatus in claim 4 wherein the bracket is further comprised of a pair of score lines, each score line between the body and one of the ears.

9. A gutter hanger apparatus for hanging gutters on a structure, comprising, in combination:
a bendable bracket/strap for fastening to the structure, the bracket strap comprising:
a bracket body having a top, a bottom, and two spaced apart sides;
an ear on each side of the body;
at least one orifice in each ear;
a hinge extended from the bottom;
an orifice in the hinge;
an orifice in the body corresponding to the hinge orifice;
a bendable strap extended from the top of the body, the strap having a first end, a second end, and a length therebetween, the first end of the strap extended from the body;
a plurality of spaced apart orifices in the length of the strap, the orifices proximal to the second end of the strap; and
a stirrup for fit around an outside of the gutter, the stirrup having a first end, a second end, and a loop therebetween, the stirrup further comprising:
a bend at the first end, the bend having an arc, wherein said arc is selected from the group consisting of 20 degrees through 45 degrees;
a hinge slot in an each side of the bend;
a curl on a second end of the stirrup;
a tang on an end of the curl;
at least two slots in the tang; and
an orifice in the tang.

10. The apparatus in claim 9 wherein a score line is provided in the bracket extension, the score line proximal to the bracket body.

11. The apparatus in claim 9 wherein the bracket is further comprised of a pair of score lines, each score line between the body and one of the ears.

12. The apparatus in claim 10 wherein the bracket is further comprised of a pair of score lines, each score line between the body and one of the ears.

13. The apparatus in claim 9 wherein the bend is further comprised of a bend tab;
an orifice in the bend tab.

14. The apparatus in claim 10 wherein the bend is further comprised of a bend tab;
an orifice in the bend tab.

15. The apparatus in claim 11 wherein the bend is further comprised of a bend tab
an orifice in the bend tab.

16. The apparatus in claim 12 wherein the bend is further comprised of a bend tab;
an orifice in the bend tab.

* * * * *